US009668561B2

(12) United States Patent
Lin

(10) Patent No.: US 9,668,561 B2
(45) Date of Patent: Jun. 6, 2017

(54) AIRTIGHT COSMETIC POWDER BOX

(71) Applicant: Libo Cosmetics Co., Ltd., Changhua County (TW)

(72) Inventor: Hsiao Yun Lin, Changhua County (TW)

(73) Assignee: LIBO COSMETICS CO., LTD., Changhua County (TW)

( * ) Notice: Subject to any disclaimer, the term of this patent is extended or adjusted under 35 U.S.C. 154(b) by 139 days.

(21) Appl. No.: 14/794,941

(22) Filed: Jul. 9, 2015

(65) Prior Publication Data

US 2017/0006995 A1 Jan. 12, 2017

(51) Int. Cl.

| | |
|---|---|
| ***B65D 53/02*** | (2006.01) |
| ***A45D 33/00*** | (2006.01) |
| ***B65D 43/16*** | (2006.01) |
| ***B65D 43/22*** | (2006.01) |
| ***A45D 33/24*** | (2006.01) |

(52) U.S. Cl.

CPC ..... *A45D 33/003* (2013.01); *A45D 33/24* (2013.01); *B65D 43/16* (2013.01); *B65D 43/22* (2013.01); *B65D 53/02* (2013.01); *A45D 2200/051* (2013.01)

(58) Field of Classification Search

CPC ..... A45D 33/003; B65D 53/02; B65D 43/22; B65D 43/16

USPC ..... 220/259.1, 259.2, 849; 132/293

See application file for complete search history.

(56) References Cited

FOREIGN PATENT DOCUMENTS

KR 20140005599 A * 1/2014 ..... A45D 34/00

* cited by examiner

*Primary Examiner* — James N Smalley

(57) ABSTRACT

An airtight cosmetic powder box includes an outer box having an upper lid and an outer box body. The outer box body includes a receiving space receiving an inner box unit. The inner box unit includes an upper cover and an inner box body. The inner box body includes an inner receiving space. A seal ring is received in an annular groove in a top face of the inner box body. The upper cover is pivotable relative to the inner box body between an open position and a closed position. The upper cover includes an annular rib extending from a bottom face of the upper cover. The annular rib is received in the annular groove of the inner box body. The bottom face of the upper cover and an inner peripheral face of the annular rib sealingly contact the seal ring, providing an airtight cosmetic powder box.

3 Claims, 4 Drawing Sheets

AIRTIGHT COSMETIC POWDER BOX

BACKGROUND OF THE INVENTION

The present invention relates to an airtight cosmetic powder box and, more particularly, to an airtight cosmetic powder box providing a double airtight effect by a seal ring abutting a bottom face of an upper cover and abutting an inner peripheral face of an annular rib of the upper cover.

A cosmetic powder box is an essential item in the purse of a female, because the makeup on the face of the female often requires reapplication due to sweating. Thus, the cosmetic powder box is required in application and reapplication of makeup and is almost a necessity in female daily lives. However, a conventional cosmetic powder box merely provides a space for receiving cosmetic powder which deteriorates by moisture. The conventional cosmetic powder box cannot prevent the cosmetic powder from moisture.

Thus, a need exists for an airtight cosmetic powder box for reliably protecting the cosmetic powder from moisture.

BRIEF SUMMARY OF THE INVENTION

The primary objective of the present invention is to provide an airtight cosmetic powder box providing a double airtight effect by a seal ring abutting a bottom face of an upper cover and abutting an inner peripheral face of an annular rib of the upper cover.

The above objective is fulfilled by an airtight cosmetic powder box including an outer box, a seal ring, and an inner box unit. The outer box includes an upper lid and an outer box body. The outer box body includes a receiving space. The inner box unit is received in the receiving space of the outer box. The inner box unit includes an upper cover and an inner box body. The inner box body includes an inner receiving space. The inner box body further includes a top face having an annular groove. The seal ring is received in the annular groove of the inner box body. The inner box body further includes a pivotal portion to which the upper cover is pivotably mounted. The upper cover is pivotable relative to the inner box body between an open position and a closed position. The upper cover includes an annular rib extending from a bottom face of the upper cover. The annular rib is received in the annular groove of the inner box body. The bottom face of the upper cover and an inner peripheral face of the annular rib sealingly contact the seal ring, providing an airtight cosmetic powder box.

In an example, the seal ring is annular and includes a peripheral wall having an outer peripheral face. The peripheral wall of the seal ring is received in the annular groove of the inner box body. The annular rib is sandwiched between an upper end of the inner box body and the peripheral wall of the seal ring. The inner peripheral face of the annular rib abuts the outer peripheral face of the peripheral wall of the seal ring, and an upper face of the seal ring abuts the bottom face of the upper cover, providing a double airtight effect. The upper end of the inner box body including an upper face. The upper face of the inner box body is located between the upper face of the seal ring and a bottom face of the annular rib, assuring the upper face of the seal ring to reliably abut the bottom face of the upper cover.

The upper cover can include a peripheral wall surrounding the outer peripheral face of the inner box body. The peripheral wall of the upper cover includes a plurality of hooks. A plurality of hooking groove is defined in the outer peripheral face of the inner box body. The plurality of hooks of the upper cover is engaged in the plurality of hooking groove, securely coupling the upper cover and the inner box body together to enhance the airtight effect.

The outer box body can further include an insertion ring fixed in the receiving space of the outer box body. The inner box body further includes an engagement groove in the outer peripheral face. The insertion ring includes a plurality of resilient tabs engaged in the engagement groove to retain the inner box body in place.

The upper cover can further include a top face having at least one high point higher than a remaining portion of the top face. When the upper lid is disposed on the top face of the upper cover, an inner face of the upper lid firstly presses against the at least one high point, and the upper lid is then further pressed, further enhancing the airtight effect between the upper lid and the inner box body.

The airtight cosmetic powder box can further include a hook device mounted between the upper lid and the outer box body. The hook device includes a button and a hook mounted to the outer box body. The hook is operably connected to the button. The upper lid includes a lip. The hook engages with the lip. The button can be operated to disengage the hook from the lip.

The airtight cosmetic powder box can further include a pivotal mechanism mounted between the upper lid and a side of the outer box body opposite to the hook device. The upper lid includes a resilient member. The resilient member pushes the upper lid outwards when the hook of the hook device disengages from the lip.

The present invention will become clearer in light of the following detailed description of illustrative embodiments of this invention described in connection with the drawings.

DETAILED DESCRIPTION OF THE INVENTION

Figure 1:
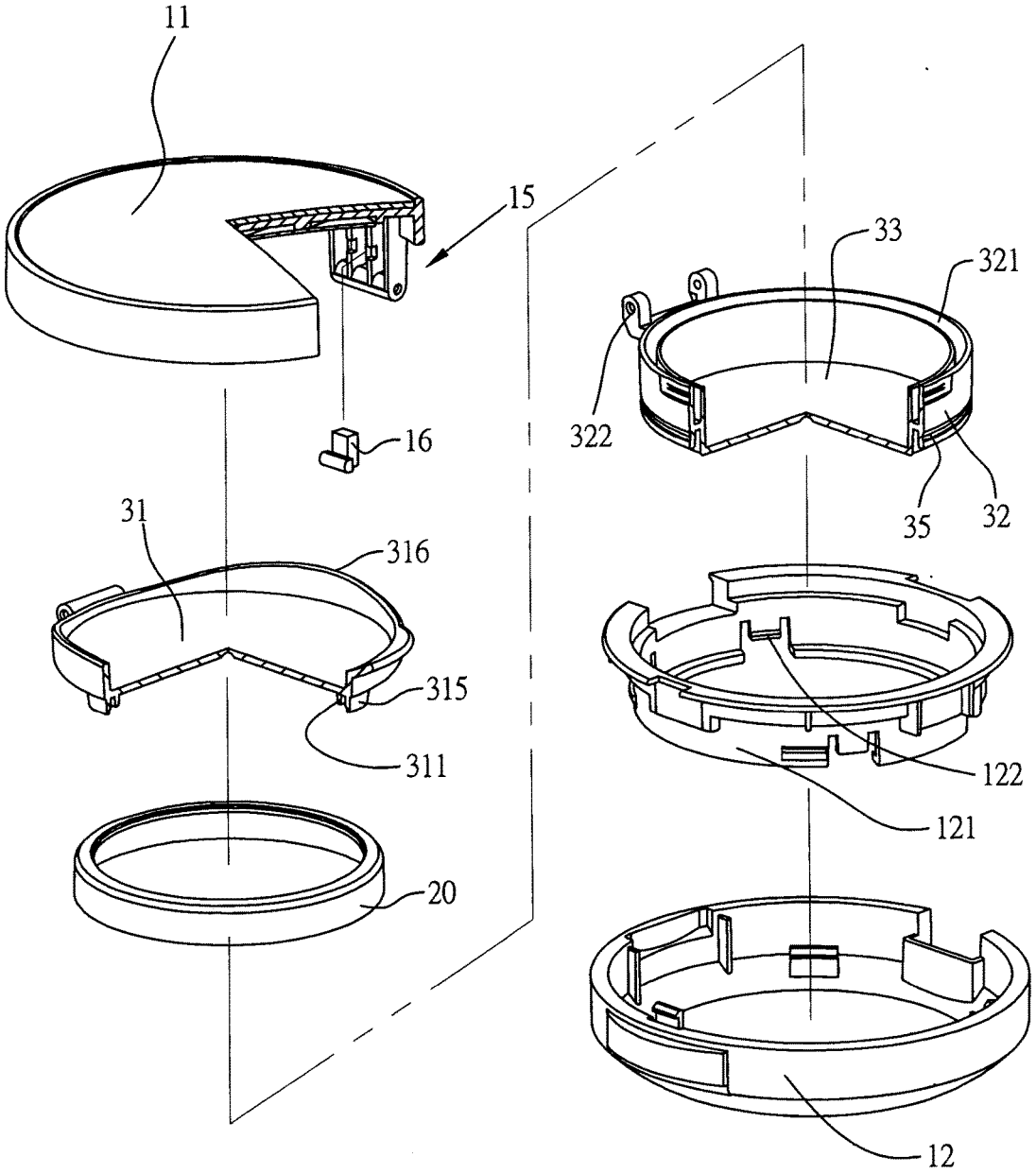
FIG. 1 is an exploded, perspective view of an airtight cosmetic powder box according to the present invention.
Figure 2:
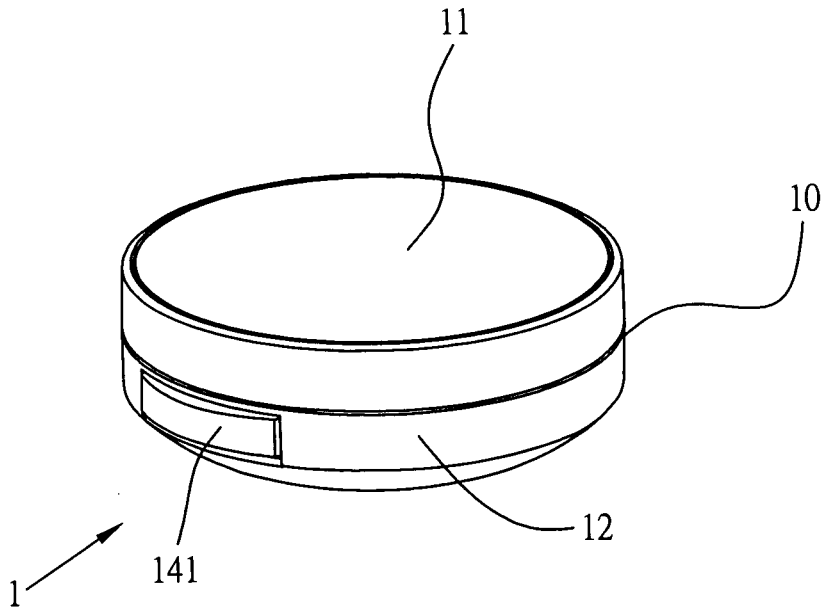
FIG. 2 is a perspective view of the airtight cosmetic powder box according to the present invention.

With reference to FIGS. 1-4, an airtight cosmetic powder box 1 according to the present invention includes an outer box 10, a seal ring 20, and an inner box unit 30. The outer box 10 includes an upper lid 11 and an outer box body 12. The outer box body 12 includes a receiving space 13. The seal ring 20 is annular includes a peripheral wall 21 having an outer peripheral face 22. The seal ring 20 further includes an upper face 23.

The inner box unit 30 is received in the receiving space 13 of the outer box 10. The inner box unit 30 includes an upper cover 31 and an inner box body 32. The inner box body 32 includes an inner receiving space 33 adapted for receiving cosmetic powder. The inner box body 32 further includes a top face having an annular groove 321. The seal ring 20 is received in the annular groove 321 of the inner box body 32. The inner box body 32 further includes a pivotal portion 322 to which the upper cover 31 is pivotably mounted. The upper cover 31 is pivotable relative to the inner box body 32 between an open position and a closed position. The upper cover 31 includes an annular rib 311 extending from a bottom face 313 of the upper cover 31 in a location corresponding to an upper end of the inner box body 32. The annular rib 311 is received in the annular groove 321 of the inner box body 32. The bottom face 313 of the upper cover 31 and an inner peripheral face 312 of the annular rib 311 sealingly contact the seal ring 20, providing an airtight cosmetic powder box 1.

Figure 3:
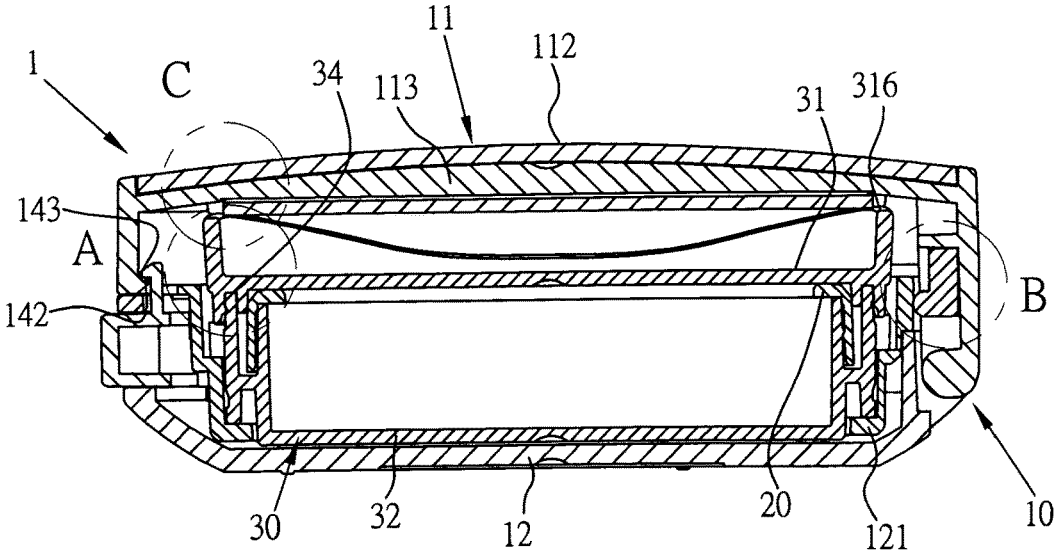
FIG. 3 is a cross sectional view of the airtight cosmetic powder box according to the present invention.
Figure 3A:
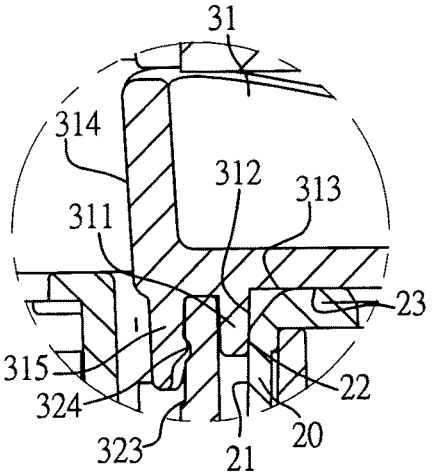
FIG. 3A is an enlarged portion of a circled portion A of FIG. 3.

With reference to FIG. 3A, the peripheral wall 21 of the seal ring 20 is surrounded by an outer peripheral face 323 of the inner box body 32. In this embodiment, the peripheral wall 21 of the seal ring 20 is received in the annular groove 321 of the inner box body 32. The annular rib 311 is sandwiched between the upper end of the inner box body 32 and the peripheral wall 21 of the seal ring 20. The inner peripheral face 312 of the annular rib 311 abuts the outer peripheral face 22 of the peripheral wall 21 of the seal ring 20, and the upper face 23 of the seal ring 20 abuts the bottom face 313 of the upper cover 31, providing a double airtight effect. The upper end of the inner box body 32 includes an upper face 34. The upper face 34 of the inner box body 32 is located between the upper face 23 of the seal ring 20 and a bottom face 318 of the annular rib 311 after the seal ring 20 is inserted into the annular groove 321 of the inner boy body 32, assuring the upper face 23 of the seal ring 20 to reliably abut the bottom face 313 of the upper cover 31.

The upper cover 31 includes a peripheral wall 314 surrounding the outer peripheral face 323 of the inner box body 32. The peripheral wall 314 of the upper cover 31 includes a plurality of hooks 315. A plurality of hooking groove 324 is defined in the outer peripheral face 323 of the inner box body 32. The hooks 315 of the upper cover 31 are engaged in the hooking groove 324, securely coupling the upper cover 31 and the inner box body 32 together to enhance the airtight effect.

The shape of the outer box 10 can be cylindrical, cubic, ellipsoid, or any other geometric arrangement.

The upper lid 11 defines a compartment 111 therein for receiving a mirror, a photograph, an illuminating device, or any other objects.

The outer box body 12 further includes an insertion ring 121. The insertion ring 121 and the outer box body 12 can be produced separately, and the insertion ring 121 can be securely inserted into the receiving space 13 of the outer box body 12. The inner box body 32 further includes an engagement groove 35 in the outer peripheral face 323. The insertion ring 121 includes a plurality of resilient tabs 122 engaged in the engagement groove 35 to retain the inner box body 32 in place.

The upper cover 31 further includes a top face having at least one high point 316 higher than a remaining portion of the top face. When the upper lid 11 is disposed on the top face of the upper cover 31, the inner face of the upper lid 11 firstly presses against the at least one high point 316 (FIG. 3C) and the upper lid 11 is then further pressed, further enhancing the airtight effect between the upper lid 31 and the inner box body 32.

The airtight cosmetic powder box further includes a hook device 14 mounted between the upper lid 11 and the outer box body 12. In this embodiment, the hook device 14 includes a button 141 and a hook 142 mounted to the outer box body 12. The hook 142 is operably connected to the button 141. The upper lid 11 includes a lip 143. The hook 142 engages with the lip 143. The button 141 can be pressed to disengage the hook 142 from the lip 143.

Figure 3B:
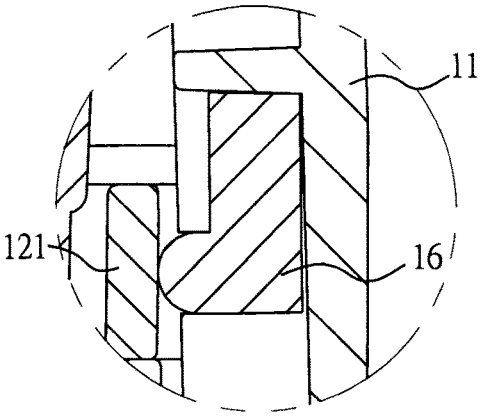
FIG. 3B is an enlarged portion of a circled portion B of FIG. 3.
Figure 3C:
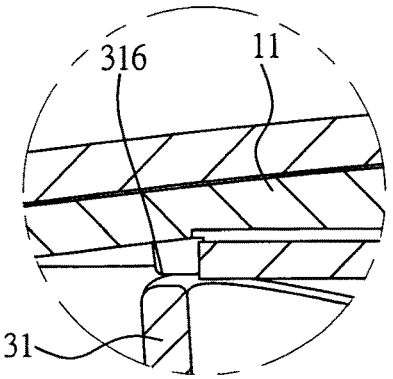
FIG. 3C is an enlarged portion of a circled portion C of FIG. 3.
Figure 4:
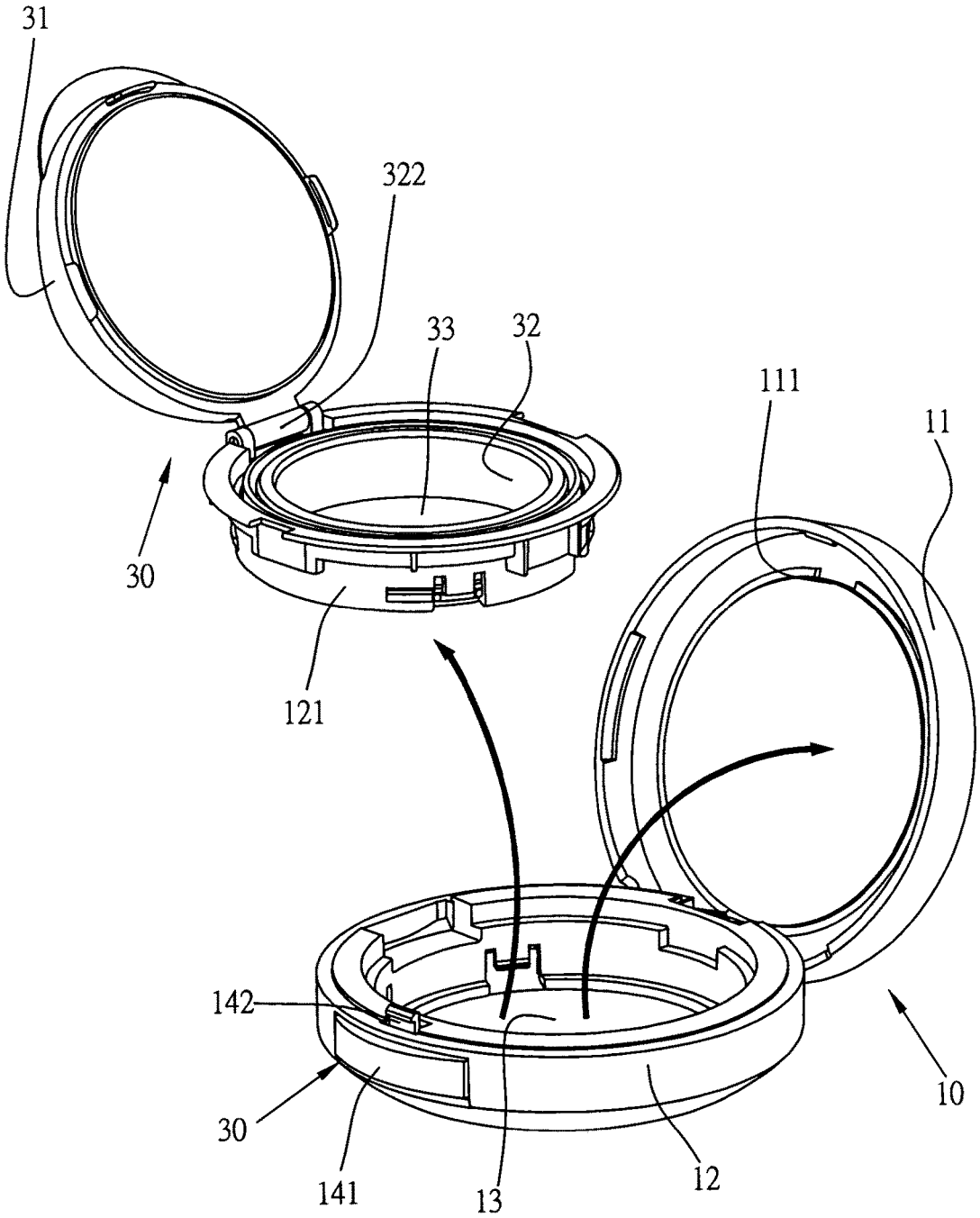
FIG. 4 is a perspective view illustrating opening of an upper lid of an outer box and removal of an inner box of the airtight cosmetic powder box according to the present invention.

The airtight cosmetic powder box can further include a pivotal mechanism 15 (FIG. 1) mounted between the upper lid 11 and a side of the outer box body 12 opposite to the hook device 14. The upper lid 11 includes a resilient member 16 (FIG. 3B). The resilient member 16 pushes the upper lid 12 outwards when the hook 142 of the hook device 14 disengages from the lip 143.

The upper lid 11 can be comprised of a two-layer structure including a primary lid 113 and a secondary lid 112. The secondary lid 112 can be transparent. A color paper or a paper having one or more figures can be received between the primary lid 113 and the secondary lid 112.

In view of the foregoing, the airtight cosmetic powder box according to the present invention provides a reliable double airtight effect in which the inner peripheral face 312 of the annular rib 311 of the upper cover 31 abuts the outer peripheral face 22 of the peripheral wall 21 of the seal ring 20, and the upper face 23 of the seal ring 20 abuts the bottom face 313 of the upper cover 31.

Although specific embodiments have been illustrated and described, numerous modifications and variations are still possible without departing from the scope of the invention. The scope of the invention is limited by the accompanying claims.

The invention claimed is:

1. An airtight cosmetic powder box comprising: an outer box including an upper lid and an outer box body, with the outer box body including a receiving space; a seal ring; and an inner box unit received in the receiving space of the outer box, with the inner box unit including an upper cover and an inner box body, the inner box body including an inner receiving space, the inner box body further including a top face having an annular groove, the seal ring received in the annular groove of the inner box body, the inner box body further including a pivotal portion to which the upper cover is pivotably mounted, the upper cover pivotable relative to the inner box body between an open position and a closed position, the upper cover including an annular rib extending from a bottom face of the upper cover, the annular rib received in the annular groove of the inner box body, and the bottom face of the upper cover and an inner peripheral face of the annular rib sealingly contacting the seal ring, providing an airtight cosmetic powder box, with the upper cover including a peripheral wall surrounding the outer peripheral face of the inner box body, with the peripheral wall of the upper cover including a plurality of hooks, with a plurality of hooking groove defined in the outer peripheral face of the inner box body, with the plurality of hooks of the upper cover engaged in the plurality of hooking groove, securely coupling the upper cover and the inner box body together to enhance the airtight effect.

2. An airtight cosmetic powder box comprising: an outer box including an upper lid and an outer box body, with the outer box body including a receiving space; a seal ring; and an inner box unit received in the receiving space of the outer box, with the inner box unit including an upper cover and an inner box body, with the inner box body including an inner receiving space, with the inner box body further including a top face having an annular groove, with the seal ring received in the annular groove of the inner box body, with the inner box body further including a pivotal portion to which the upper cover is pivotably mounted, with the upper cover pivotable relative to the inner box body between an open position and a closed position, with the upper cover including an annular rib extending from a bottom face of the upper cover, with the annular rib received in the annular groove of the inner box body, and with the bottom face of the upper cover and an inner peripheral face of the annular rib sealingly contacting the seal ring, providing an airtight cosmetic powder box, with the seal ring being annular and including a peripheral wall having an outer peripheral face, the peripheral wall of the seal ring received in the annular groove of the inner box body, the annular rib sandwiched between an upper end of the inner box body and the peripheral wall of the seal ring, the inner peripheral face of the annular rib abutting the outer peripheral face of the peripheral wall of the seal ring, the seal ring further including an upper face abutting the bottom face of the upper cover, providing a double airtight effect, with the upper end of the inner box body including an upper face, and the upper face of the inner box body located between the upper face of the seal ring and a bottom face of the annular rib, assuring the upper face of the seal ring to reliably abut the bottom face of the upper cover, with the outer box body further including an insertion ring fixed in the receiving space of the outer box body, with the inner box body further including an engagement groove in the outer peripheral face, with the insertion ring including a plurality of resilient tabs engaged in the engagement groove to retain the inner box body in place.

3. An airtight cosmetic powder box comprising: an outer box including an upper lid and an outer box body, with the outer box body including a receiving space; a seal ring; and an inner box unit received in the receiving space of the outer box, the inner box unit including an upper cover and an inner box body, the inner box body including an inner receiving space, the inner box body further including a top face having an annular groove, the seal ring received in the annular groove of the inner box body, the inner box body further including a pivotal portion to which the upper cover is pivotably mounted, the upper cover pivotable relative to the inner box body between an open position and a closed position, the upper cover including an annular rib extending from a bottom face of the upper cover, the annular rib received in the annular groove of the inner box body, and the bottom face of the upper cover and an inner peripheral face of the annular rib sealingly contacting the seal ring, providing an airtight cosmetic powder box, with the seal ring being annular and including a peripheral wall having an outer peripheral face, the peripheral wall of the seal ring received in the annular groove of the inner box body, the annular rib sandwiched between an upper end of the inner box body and the peripheral wall of the seal ring, the inner peripheral face of the annular rib abutting the outer peripheral face of the peripheral wall of the seal ring, with the seal ring further including an upper face abutting the bottom face of the upper cover, providing a double airtight effect, the upper end of the inner box body including an upper face, and the upper face of the inner box body located between the upper face of the seal ring and a bottom face of the annular rib, assuring the upper face of the seal ring to reliably abut the bottom face of the upper cover, with the upper cover further including a top face having at least one high point higher than a remaining portion of the top face, with the upper lid including an inner face, wherein when the upper lid is disposed on the top face of the upper cover, the inner face of the upper lid firstly presses against the at least one high point, and the upper lid is then further pressed, further enhancing the airtight effect between the upper lid and the inner box body.

* * * * *